US007500767B2

(12) United States Patent
Wyatt

(10) Patent No.: US 7,500,767 B2
(45) Date of Patent: Mar. 10, 2009

(54) DIRECTIONAL CANOPY LUMINAIRE

(75) Inventor: Michael Dean Wyatt, Hamilton, OH (US)

(73) Assignee: LSI Industries, Inc., Cincinnati, OH (US)

( * ) Notice: Subject to any disclaimer, the term of this patent is extended or adjusted under 35 U.S.C. 154(b) by 0 days.

(21) Appl. No.: 11/615,429

(22) Filed: Dec. 22, 2006

(65) Prior Publication Data

US 2007/0147052 A1 Jun. 28, 2007

Related U.S. Application Data

(60) Provisional application No. 60/753,873, filed on Dec. 23, 2005.

(51) Int. Cl.
*F21V 8/00* (2006.01)

(52) U.S. Cl. ..... 362/427; 362/404; 362/419

(58) Field of Classification Search ..... 362/418–419, 362/427, 404, 470–472, 488, 393, 269, 285, 362/287

See application file for complete search history.

(56) References Cited

U.S. PATENT DOCUMENTS

| | | | | |
|---|---|---|---|---|
| 2,712,060 | A * | 6/1955 | Johnson | 362/419 |
| 3,895,407 | A * | 7/1975 | Elvers et al. | 340/907 |
| 4,527,224 | A | 7/1985 | Sangiamo et al. | |
| 4,760,507 | A * | 7/1988 | Lasker et al. | 362/239 |
| 5,093,769 | A * | 3/1992 | Luntsford | 362/269 |
| 5,140,507 | A | 8/1992 | Harwood | |
| 5,662,407 | A * | 9/1997 | Fischer et al. | 362/147 |
| 5,927,843 | A | 7/1999 | Haugaard et al. | |
| 6,231,214 | B1 | 5/2001 | Haugaard | |
| 6,402,352 | B1 | 6/2002 | Summerford et al. | |
| 2003/0086273 | A1 | 5/2003 | Canuel | |
| 2004/0001336 | A1 | 1/2004 | Wang et al. | |
| 2005/0201082 | A1 | 9/2005 | Mauk et al. | |

OTHER PUBLICATIONS

Beta Lighting, Members Only Product Sheet, Catalog No. BGG707-D, Obtained from the website www.beta-lighting.com, on Jul. 29, 2005 (2 pages).

Duetto®, LSI Industries Inc., Obtained from the website www.lsi-industries.com, (1 page) (dated 2007; but first publically available before Dec. 2004).

Track in the Box, LSI Industries Inc., Obtained from the website www.lsi-industries.com, (1 page) (dated 2007; but first publically available before Dec. 2004).

(Continued)

*Primary Examiner*—Anabel Ton
*Assistant Examiner*—Julie A. Shallenberger
(74) *Attorney, Agent, or Firm*—Hasse & Nesbitt LLC; Daniel F. Nesbitt

(57) ABSTRACT

A directional canopy luminaire that can be easily and quickly adjusted to direct light from a canopy toward a particular target area without scattering light to unintended areas. The luminaire includes an outer housing having an aperture, a directional support rotatably mounted within the outer housing, an inner support pivotally affixed to the directional support, and a light supporting means. The light supporting means is typically configured to support a replaceable lamp that is electrically connectable to an electric power source. Light can be aimed in any desired direction through the aperture of the luminaire by pivoting into a position the directional support and the inner support.

6 Claims, 4 Drawing Sheets

OTHER PUBLICATIONS

Gimbal Rings—Line Voltage, LSI Industries Inc., Obtained from the website www.lsi-industries.com, (1 page) (dated 2007; but first publically available before Dec. 2004).
Roundback Cylinders—Line Voltage & Low Voltage, LSI Industries Inc., Obtained from the website www.lsi-industries.com, (1 page) (dated 2007; but first publically available before Dec. 2004).
Socket Housing Assembly Duetto, LSI Industries Inc., Part No. 211500, Obtained from the website www.lsi-industries.com, (1 page) (revision dated Apr. 6, 2006; first publically available before Dec. 2004).

* cited by examiner

DIRECTIONAL CANOPY LUMINAIRE

CROSS REFERENCE TO RELATED APPLICATION

The present application claims the benefit of co-pending U.S. provisional patent application 60/753,873, filed Dec. 23, 2005.

FIELD OF THE INVENTION

This invention relates generally to canopy luminaires and more particularly to canopy luminaires adapted to direct light in a desired direction.

BACKGROUND OF THE INVENTION

Luminaires are used in many commercial and consumer venues to illuminate particular areas of a site, such as lighting for a service station, storefront or restaurant, and are typically mounted on or within a support structure such as a ceiling, canopy structure or building exterior.

Luminaires of currently existing designs are typically mounted on their support structures either by direct attachment to the structure or by creating an opening and installing the recessed luminaire into the opening. A typical drawback associated with many existing luminaires is that the lamp is mounted in a fixed position on or within the support structure, thereby prohibiting redirection of the light emanating from the lamp toward specific, desired areas below. Although lenses can be used to direct the light toward a particular area and focus the light output downward, a substantial portion of the luminous output of the lamp is nevertheless emitted in other directions.

Some existing luminaires permit movement of the luminaire body to direct the light output, most notably track lighting. However, such existing luminaires are not designed to withstand outside environments, such as weather and insects. Further, many have limitations in the rotational range of the lamps and cannot be easily locked into place. Still further, recent environmental regulations such as Title 24 in California, which went into effect in Oct. of 2005, require a canopy luminaire to have a flat lens and not protrude below the level of the canopy.

One other drawback associated with existing luminaires, again relating to the difficulty in directing the light output toward the intended area, involves the need for using a larger lamp, such as a high intensity discharge (HID) lamp, to provide the desired level of lighting. As the lens cannot efficiently direct the high intensity light to specific areas, much of the light is scattered toward unintended local and distant destinations. This scattering results in light pollution issues ranging from the disturbance of neighbors to interference of night sky viewing.

Thus, there is a substantial need for a luminaire that may be easily and quickly adjusted to direct light toward a particular target area without scattering light to unintended areas. There is also a need for an adjustable canopy luminaire in which the lamp does not protrude below the canopy. Further, there is a significant need for a luminaire that is capable of using a smaller lamp and consuming less electricity in its operation while providing the same degree of illumination.

SUMMARY OF THE INVENTION

The present invention provides a directional canopy luminaire that overcomes the drawbacks associated with currently existing luminaires. One aspect of the directional canopy luminaire of the present invention comprises an outer housing having an aperture; a directional support rotatably mounted within the outer housing; an inner support pivotally affixed to the directional support; and a light supporting means affixed to the inner support and configured to support a replaceable lamp that is electrically connectable to an electric power source, wherein the light supporting means is operable to aim light emitted from the replaceable lamp in any desired direction through the aperture of the outer housing.

Another aspect of the present invention is a directional canopy luminaire comprising an outer housing having an aperture; an inner support including a socket end adapted to hold a lamp socket that is electrically connected to a power source, and an open end adapted to receive a reflector that surrounds a replaceable lamp received in the lamp socket; and a directional support rotatably mounted on a vertical axis within the outer housing and adapted to pivotally affix the inner support on a horizontal axis within the outer housing, wherein the directional support and the inner support cooperate to permit light emitted from the replaceable lamp to be aimed in any desired direction through the aperture.

Another aspect of the present invention is a directional canopy luminaire comprising an outer housing having an aperture and configured to be secured to a canopy, an inner support for a light supporting means, the light supporting means including a replaceable lamp electrically connectable to an electric power source; and a directional support rotatably mounted on a vertical axis within the outer housing and adapted to pivotally affix the inner support on a horizontal axis within the outer housing, wherein the luminaire is operable to aim light emitted from the replaceable lamp in any desired direction through the aperture of the outer housing. The directional support is typically adapted to be rotatably mounted within the outer housing and can include a first and a second side arm at its lower end to pivotally affix the inner support about the horizontal axis within the outer housing.

The outer housing of the various aspects of the invention typically includes a body having an upper portion, a neck extending upwardly from the upper portion, at least one external securing member to secure the outer housing to the canopy, a base defining the aperture, and a mounting means situated within the outer housing proximate the upper portion (i.e. on the inside of the outer housing, between the neck and the body) that is adapted to rotatably mount the directional support. A cover for the outer housing can be hingedly connected to the base, and comprise a cover lens extending over the aperture.

The light supporting means of the various aspects of the invention can include any means that cooperates with a replaceable lamp to produce light, so that the luminaire can preferably function to aim the emitted light through the aperture of the outer housing. The light supporting means typically includes a lamp socket electrically connected to the power source, and, in one embodiment, a reflector that surrounds the replaceable lamp and reflects incident light from the lamp outwardly through the aperture of the outer housing. The reflector typically includes a reflective dome having an inner reflective surface, a lower rim defining a light-emitting opening and an upper rim defining a hole for the replaceable lamp to pass through to the lamp socket. The inner reflective surface reflects incident light through the light-emitting opening of the dome. One embodiment of the reflector can include a lower rim with at least one spring connector configured to removably secure the reflector within an inner support that fully encloses the reflector. This fully-encircling inner support is also known herein as an inner housing.

A typical embodiment provides a luminaire that can be easily and quickly adjusted to direct light toward a particular target area without scattering light to unintended areas, and houses a lamp that does not protrude below the ceiling of the canopy. The adjustable canopy luminaire can use a smaller lamp and consume less electricity in its operation while providing the same degree of illumination to a target location as does a larger lamp size in a conventional luminaire.

The nature and advantages of the present invention will be more fully appreciated from the following drawings, detailed description, and appending claims.

DETAILED DESCRIPTION OF THE INVENTION

Figure 1:
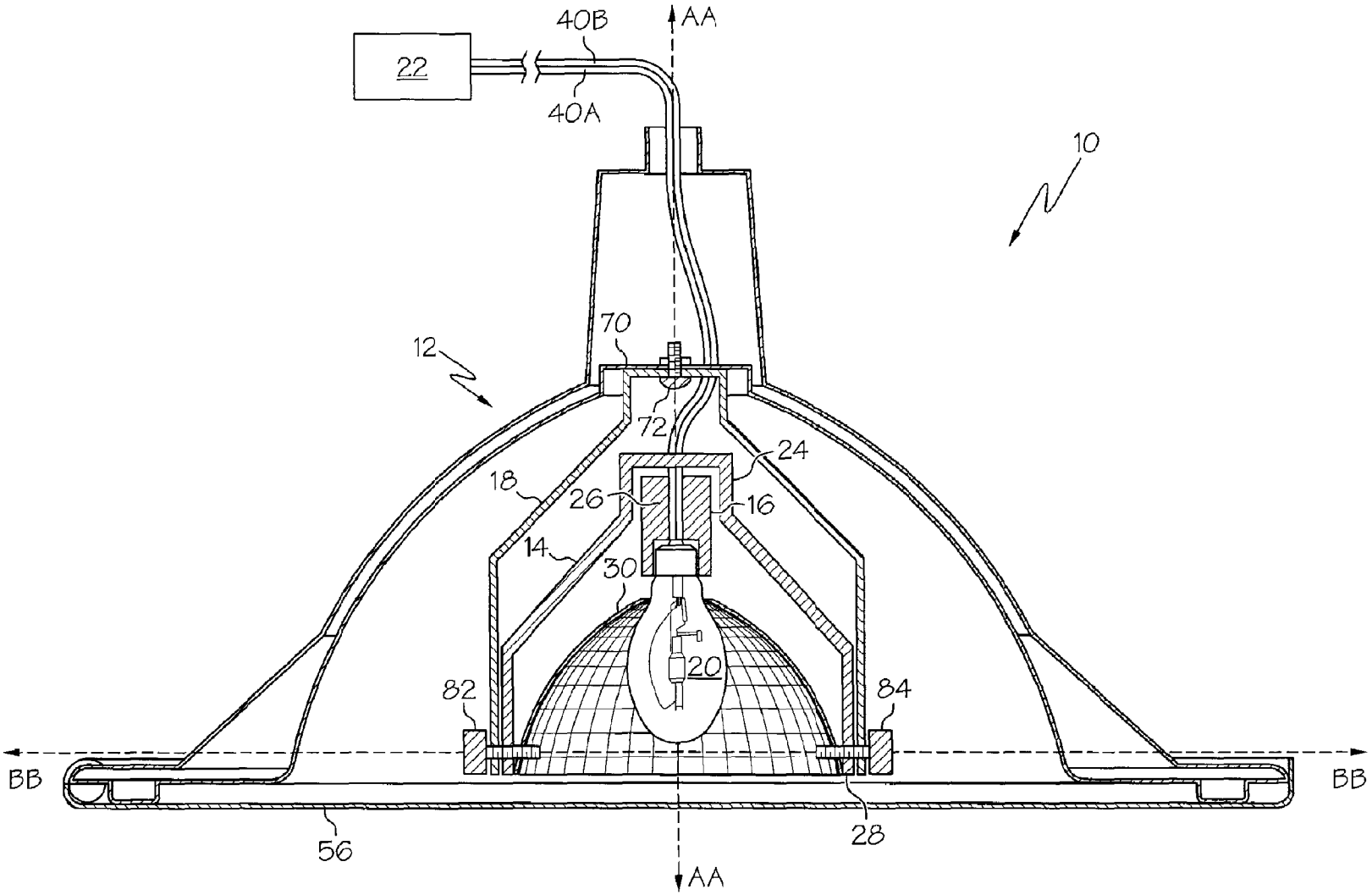
FIG. 1 is a side cross-sectional view of one embodiment of the luminaire of the present invention.

The directional canopy luminaire 10 depicted in FIG. 1. The directional canopy luminaire 10 is typically used in a canopy, such as a horizontal structure that serves as a roof to shelter an area from weather, although the luminaire can be used in ceilings of other structures. The directional canopy luminaire 10has an outer housing 12 an inner support 14 a light supporting means 16 and a directional support 18 A replaceable lamp 20 is associated with the light supporting means 16 for electrical connection to an electric power source 22. The light supporting means 16 comprises a lamp socket 26 and a reflector 30, which cooperate with a replaceable lamp 20 to produce light. The inner support 14 includes a socket end 24 adapted to support the lamp socket 26, and an open end 28 adapted to receive the reflector 30. The reflector 30 is adapted to surround the replaceable lamp 20 as it is received into the lamp socket 26. The lamp socket 26 is electrically connected to the inserted lamp 20, and electrical wires 40A, 40B connect the lamp socket 26 to an electric power source 22. A cover 56 is located at the lower end of the outer housing 12.

Figure 2:
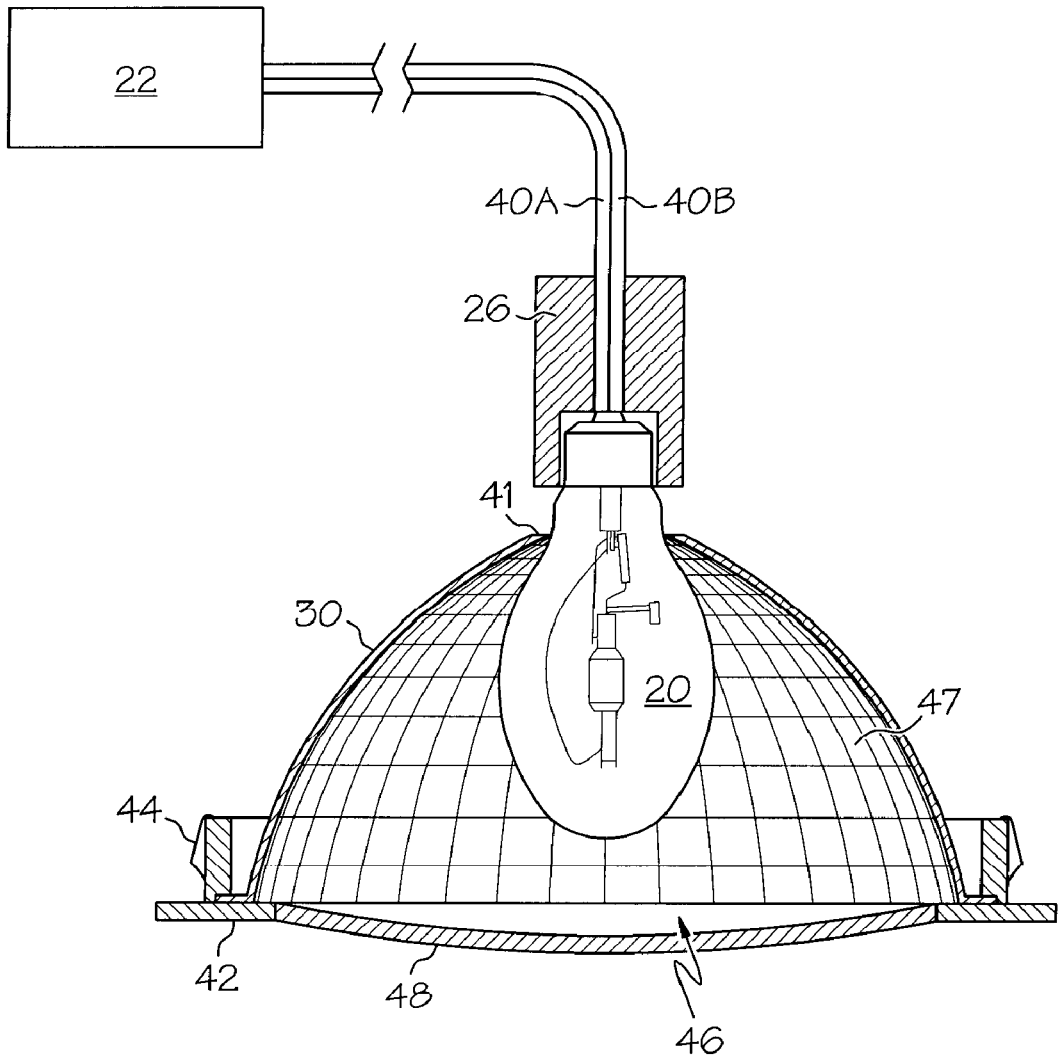
FIG. 2 is a side cross-sectional view of another embodiment of the luminaire of the present invention.

FIG. 2 illustrates another embodiment of the luminaire of the present invention. The outer housing 12 includes a base 54 having an edge 53 defining an aperture 52, a body 58 continuing upwardly from the edge 53 of the base 54 and having an upper portion 60, a neck 62 continuing upwardly from the upper portion 60, and external securing members 64. The external securing members 64 are typically located on the external surface of the outer housing 12, and are adapted to receive screws or other securing means by which the outer housing 12 can be secured to the canopy. A mounting means 70 (FIG. 3) is located within the outer housing 12, proximate the junction of the neck 62 and the body 58. A cover 56 for the outer housing is optional, but is illustrated here connected to the base via one or more hinges 57. The cover 56 is openable and closeable, and includes a latch 61 that is adapted to fit into and be secured by a catch 63 located on the undersurface of the base 54. The cover 56 is movable via the hinges 57 and protects the inside of the outer housing 12 by extending over the aperture 52. The cover 56 can be made of any material suitable for protecting the contents of the outer housing, and includes a transparent central portion that allows light from the lamp 20 to pass through.

FIG. 2 illustrates another embodiment of the luminaire of the present invention. The outer housing 12 includes a base 54 defining an aperture 52, a body 58 continuing upwardly from the base 54 and having an upper portion 60, a neck 62 continuing upwardly from the upper portion 60, and external securing members 64. The external securing members 64 are typically located on the external surface of the outer housing 12, and are adapted to receive screws or other securing means by which the outer housing 12 can be secured to the canopy. A mounting means 70 (FIG. 3) is located within the outer housing 12, proximate the junction of the neck 62 and the body 58. A cover 56 for the outer housing is optional, but is illustrated here connected to the base via one or more hinges 57. The cover 56 is openable and closeable, and includes a latch 61 that is adapted to fit into and be secured by a catch 63 located on the undersurface of the base 54. The cover 56 is movable via the hinges 57 and protects the inside of the outer housing 12 by extending over the aperture 52. The cover 56 can be made of any material suitable for protecting the contents of the outer housing, and includes a transparent central portion that allows light from the lamp 20 to pass through.

Figure 3:
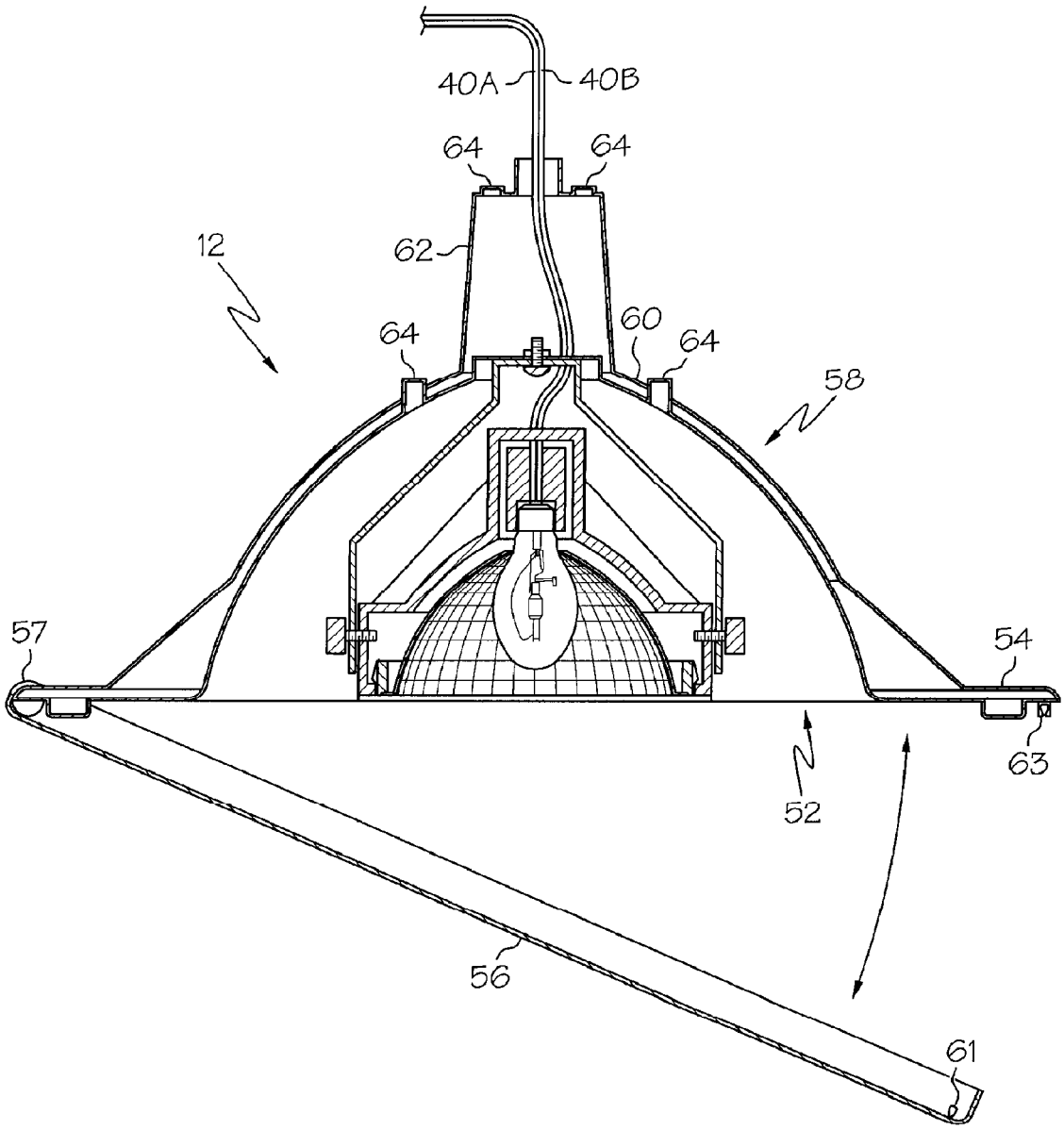
FIG. 3 is an exploded partial view of the luminaire of FIG. 2.

The luminaire 10 of the present invention is operable to aim light in any desired direction through the aperture 52 of the outer housing 12. In FIG. 3, an exploded view illustrates that an upper end of the directional support 18 is typically received into the body 58 of the outer housing 12 and pivotally mounted about vertical axis AA to the mounting means 70 within the outer housing. The open end 28 of the inner support 15 (shown as an inner housing) is rotatably affixed to the other end of the directional support 18 about horizontal axis BB. Vertical axis AA and horizontal axis BB are typical disposed in the lamp at a true vertical and true horizontal orientation, but can also be disposed off of the true orientations, such as +/ −30° from true vertical and true horizontal, respectively. The open end 28 of the inner support 15 receives the reflector 30 within its housing. The socket end 24 of the inner support 15 receives the lamp socket 26, which receives the lamp 20 as it passes through hole 41 of the reflector 30.

The directional support 18 as illustrated in FIG. 3 is typically a yoke-type structure having its upper end secured to the mounting means 70 located within the outer housing 12, proximate the junction of the neck 62 and the body 58. A rotational adjustment connector, illustrated as a bolt 72 including a washer 74 and a nut 76, rotatably secures the upper end of the directional support 18 to the mounting means 70, so that the directional support rotates about axis AA. The lower end of the directional support 18 is typically bifurcated to include side arms 78 and 80. Pivotal adjustment connectors 82, 84 typically pass through holes in the side arms 78, 80 of the directional support proximate the open end 28 of the inner support 15, and are typically pins or bolts that can be reversibly secured into threaded bolt holes 86, 88 of the inner support 15. The pivotal adjustment connectors 82, 84 serve to pivot the inner support 15 and the reflector 30 about horizontal axis BB.

Figure 4:
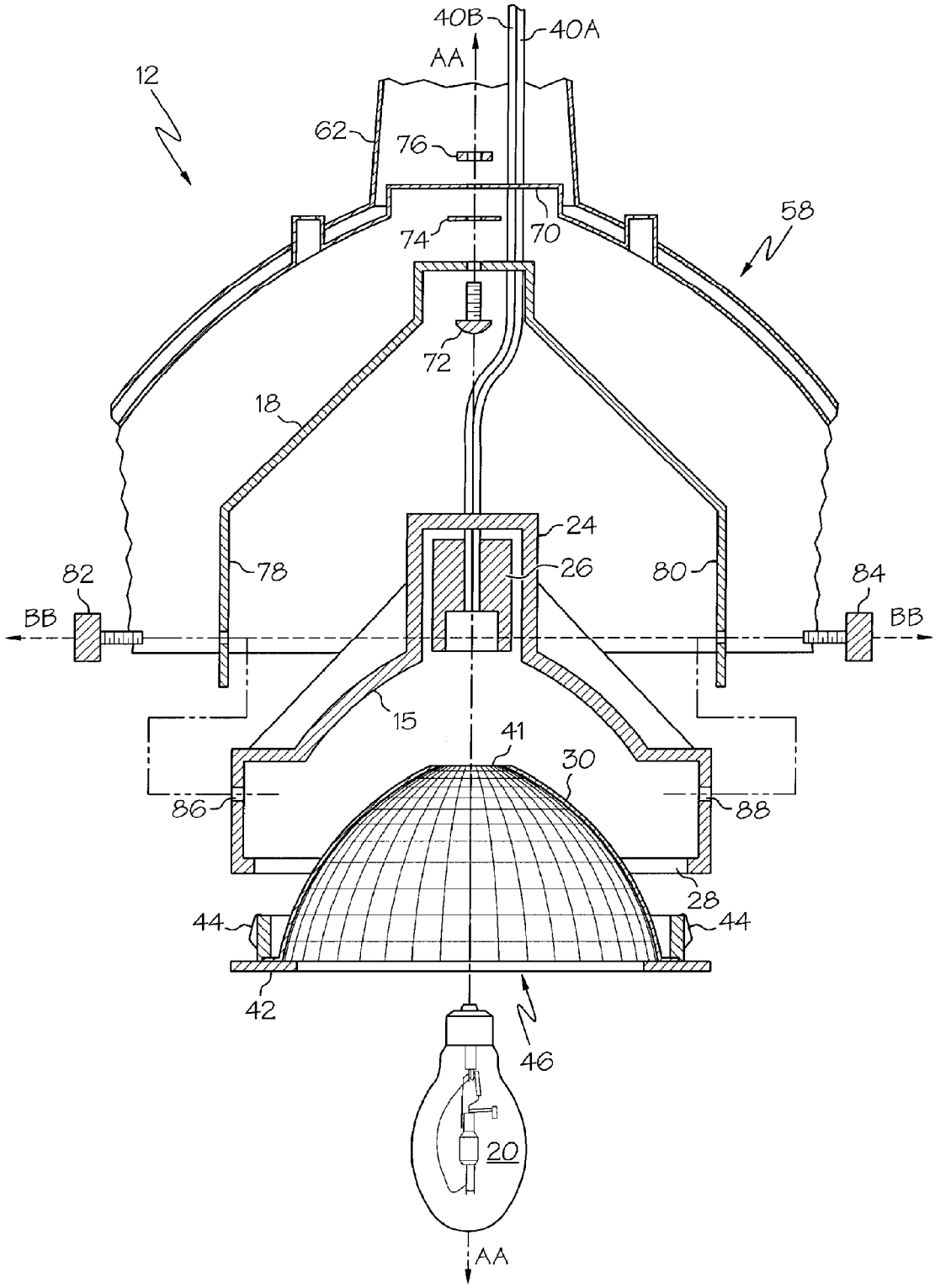
FIG. 4 is a side cross-sectional view of the light supporting means and replaceable lamp of FIG. 2.

FIG. 4 illustrates in detail the light supporting means that includes the lamp socket 26 and the reflector 30, in association with the replaceable lamp 20 and the power source 22 that includes wires 40A and 40B, to produce light. The reflector 30 is in the form of a reflective dome that surrounds the replaceable lamp 20 as it passes through hole 41 in the upper rim of the reflector to engage with the socket 26. In the embodiment shown, the reflector 30 also includes a lower rim 32 that engages (such as by a tongue and groove means) a reflector support 42. The lower rim 32 of the reflector 30 defines the light-emitting opening 46. Biasing spring connectors 44 located at intervals around the outer periphery of the reflector support 42 are used to frictionally secure the reflector support 42 to the open end 28 of the inner support 15. The reflector support 42 or lower rim 32 of the reflector 30 can also comprise a lens 48 that spans the opening 46 of the reflector 30. As will be described in more detail below, the reflector support 42 with the spring connectors 44 is intended for use with a reflector that is received into an inner support that fully encircles or encompasses the reflector.

As further illustrated in FIG. 4, the reflector 30 also includes a reflective inner portion 47 to allow incident light from the lamp 20 to be reflected through the reflector opening 46 and then outwardly through the aperture of the outer housing. The lamp 20 as shown is a high intensity discharge (HID) lamp, but could be any type of lamp, including HID, fluorescent or an incandescent lamp. In an alternative embodiment, a reflector, lens and lamp combination, known as a PAR lamp, can be used. PAR is an acronym for parabolic aluminized reflector, and is used to designate a sealed-beam lamp similar to the headlight in an automobile.

The lower rim 42 of the reflector 30 of FIG. 3 and 4 includes spring connectors 44 that allow the reflector 30 to be removably placed within the inner support 15, at the open end 28 of the inner support When the reflector 30 is inserted within the open end 28 of the inner support 15 in this manner, the housing of the inner support 15 fully encloses the body (or periphery) of the reflector 30, and the spring connectors 44 support the weight of the reflector 30 as it sits within the housing. Thus, the spring connectors 44 allow the reflector 30 to be easily inserted and removed from the open end 28 of the inner support. When the reflector 30 is in the inserted position within the inner support 15, the opening 46 of the reflector corresponds with the open end 28 of the inner support 15.

As indicated above, the embodiment of the inner support 14 illustrated in FIG. 1 is a yoke-type support, and does not a fully enclose the circumference of the reflector, as does the embodiment of the inner support 15 illustrated in FIG. 3. However, each embodiment of the inner support illustrated and described herein is intended to receive a light supporting means, which typically includes the replaceable lamp 20, the lamp socket 26, and the reflector 30. Further, the yoke-type embodiment of the inner support can save on overall production costs, since it does not require as much material as the fully enclosing inner support 15 of FIG. 3.

In practice, the directional support and the inner support cooperate to permit light to be aimed in any desired direction through the aperture of the outer housing. Thus, a light beam originating from the lamp of the luminaire can be adjusted as desired, both on a vertical plane and along a horizontal vector. For example, the rotational adjustment connector 72 permits the directional support 18 to be rotated from within a 360° rotation about vertical axis AA within the outer housing, thereby allowing the horizontal vector of the light to be aimed radially outwardly in any desired direction.

Similarly, the pivotal adjustment connectors 82, 84 permit the inner support and associated light supporting means to pivot along a vertical plan about horizontal axis BB within the outer housing. The inner support 15 is free to be pivoted about horizontal axis BB typically from between about 0° to about 60° from nadir (i.e., from true vertical), more typically from between about 0° to about 40° from nadir, thereby allowing light to be aimed in a desired vertical angle through the aperture 52 of the outer housing 12. When the desired vertical alignment has been achieved, then the inner support 15 can be secured into place by tightening the pivotal adjustment connectors 82, 84 through side arms 78, 80 and into bolt holes 86, 88.

The directional support of the various aspects of the invention is typically radially rotatable within the outer housing, and light originating from the inner support is typically vertically pivotable. That is, typically the directional support is able to rotate within a 360° rotation on a vertical axis within the outer housing. Rotation of more than a full 360° turn is typically not permitted or possible, due to potential tangling of electrical wires 40A, 40B that exit the lamp socket and proceed to the electrical power source 22. Similarly, typically the inner support pivots from about 0° (i.e. pointing straight down) to about 60° from nadir on a horizontal axis within the outer housing. In a preferred embodiment, the inner support pivots from 0° to about 40° from nadir The directional support and the inner support thus can cooperate to permit light from the lamp or light supporting means to be aimed in any desired radial direction and along any vertical angle below the level of the aperture of the outer housing.

The rotational range of the lamp within the luminaire allows the light to be aimed in any desired direction beneath the canopy, to efficiently direct the high intensity light to the intended display item(s). For example, since the aperture of the outer housing is typically flush with the lower portion of the canopy it is mounted in, and the light from the lamp will target a display item below the canopy, then the light will typically be required to be aimed along an angle from about 0° (straight down) up to about 60° from nadir. Thus, the luminaire of the present invention can direct light to a display item located in any radial direction, from directly below the luminaire out to any angle from about 0° to about 60°. After the direction of light is properly positioned, the lamp direction can then be easily locked into place.

The invention also relates to a means for aligning the direction of the light beam emitted from the aperture of the outer housing onto an outside surface. As a non-limiting example, a battery-powered visible light laser device can comprise a visible light laser attached and secured into a position normal to the base of a suction cup. The device can be placed on the distal end of the lamp along the central axis of the lamp, corresponding to the center of the pattern of light emitted from the reflector. The laser beam can then be aimed at the desired outside surface, such as a display item, representing the pattern of light that would emanate from the light source. When the desired position of the lamp has been determined by use of the laser guidance (i.e., by directing the laser light onto the desired outside surface), then the adjustment connectors for the directional support (if any) and the inner support (which determine the vertical angle of the beam) can be optionally locked into place. The suction cup end of the laser device can then be removed from the lamp, and the luminaire is ready for use. This means of aligning the light beam coming from the luminaire, which employs a laser beam, is advantageous for aligning the beam direction during the daytime, thus avoiding the need to wait for darkness in order to align the luminaire to shine upon the desired display.

The invention also relates to a method for positioning the emitted light from a directional luminaire onto an outside surface, comprising the steps of: 1) providing a directional luminaire having a lamp and means for directing the emitted light from the lamp in a principle direction; 2) providing a visible light laser device comprising a visible light laser, a means for attaching the device to a substantially planar surface of the luminaire, and a means for aligning the emitted laser light in a direction normal to the planar surface; 3) securing the visible light laser device to the planar surface, typically the distal end of the lamp, wherein line of visible laser light is aligned along the center of the pattern of light emitted from the reflector by the lamp; 4) positioning the directing means whereby the line of visible laser light alights upon the outside surface; 5) optionally securing the directing means into such position; and 6) removing the visible light laser device from the planar surface.

The luminaire of the present invention is designed to withstand outside environments and is typically constructed of durable materials such as aluminum, steel, fiberglass, plastic, or the like. For example, the housing is preferably manufactured from die cast aluminum that provides a light but strong construction, and that readily dissipates heat to prolong component life. The cover, internal housing, directional support, spring clips, etc. can be manufactured from galvanized or stainless steel, tempered aluminum, plastic, or other material. The reflector can be manufactured from specular aluminum; however, any reflective material may be used.

While the present invention has been illustrated by the description of embodiments and examples thereof, it is not intended to restrict or in any way limit the scope of the appended claims to such detail. Additional advantages and modifications will be readily apparent to those skilled in the art. Accordingly, departures may be made from such details without departing from the scope or spirit of the invention.

What is claimed is:

1. A directional canopy luminaire, comprising a. an outer housing including a base having an edge that defines an aperture, a body extending upwardly from the edge and having an upper portion, a neck extending from the upper portion, a mounting means disposed proximate the upper portion, and at least one external securing member to secure the outer housing to a canopy;

b. a directional support including a first end adapted to be rotatably mounted on a vertical axis to the mounting means within the outer housing, and a second end comprising at least a first and a second side arm having pivotal affixment means;

c. an inner support pivotally affixed to the pivotal affixment means of the directional support on a horizontal axis within the outer housing; and d. a light supporting means affixed to the inner support and configured to support a replaceable lamp electrically connectable to an electric power source, wherein the replaceable lamp does not protrude below the ceiling of the canopy, wherein the luminaire is operable to aim light emitted from the replaceable lamp in any desired direction through the aperture of the outer housing.

2. The luminaire of claim 1, the outer housing further including a cover hingedly connected to the base and a cover lens extending over the aperture.

3. The luminaire of claim 2, wherein one side of the cover is attached to the outer housing with hinges and the opposite side of the cover is attached to the outer housing with a flexible clasp mechanism.

4. The luminaire of claim 1, wherein the inner support comprises a socket end and open end, and the light supporting means is a lamp socket electrically connected to the power source and adapted to receive the replaceable lamp to produce light, and the open end is adapted to receive a reflector that surrounds the replaceable lamp and reflects incident light from the lamp outwardly through the aperture of the outer housing.

5. The luminaire of claim 4, wherein the inner support fully encircles the reflector as a housing for the reflector, the reflector comprising a reflective dome having an inner reflective surface, a lower rim defining a light-emitting opening and an upper rim defining a hole for the replaceable lamp to pass through to the lamp socket, the lower rim having at least one spring connector configured to reversibly secure the reflector within the open end of the inner support.

6. The luminaire of claim 5, wherein the light-emitting opening is covered by a reflector lens.

* * * * *